US008245553B2

(12) United States Patent
Hayashi

(10) Patent No.: US 8,245,553 B2
(45) Date of Patent: Aug. 21, 2012

(54) METHOD OF PRODUCING ULTRATHIN-WALL SEAMLESS METAL TUBE USING FLOATING PLUG

(75) Inventor: Chihiro Hayashi, Sendai (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 13/151,298

(22) Filed: Jun. 2, 2011

(65) Prior Publication Data

US 2011/0232352 A1 Sep. 29, 2011

Related U.S. Application Data

(63) Continuation of application No. PCT/JP2009/069151, filed on Nov. 11, 2009.

(30) Foreign Application Priority Data

Dec. 3, 2008 (JP) ..... 2008-308601

(51) Int. Cl.
*B21C 1/24* (2006.01)

(52) U.S. Cl. ..... 72/283; 72/274; 72/370.25

(58) Field of Classification Search ..... 72/274, 72/278, 283, 370.01, 370.14, 370.25
See application file for complete search history.

(56) References Cited

U.S. PATENT DOCUMENTS

| | | | | | |
|---|---|---|---|---|---|
| 307,993 | A | * | 11/1884 | Sharp | 72/276 |
| 520,296 | A | * | 5/1894 | Cayley | 72/256 |
| 718,671 | A | * | 1/1903 | Stiefel et al. | 72/283 |
| 880,563 | A | * | 3/1908 | McTear | 72/463 |
| 2,335,933 | A | * | 12/1943 | Goheen, Jr. et al. | 72/42 |
| 2,355,734 | A | * | 8/1944 | Katz | 72/45 |
| 2,359,339 | A | * | 10/1944 | Wadell | 72/466.9 |
| 3,605,476 | A | * | 9/1971 | Hinshaw | 72/274 |
| 4,856,703 | A | * | 8/1989 | Uhlmann | 228/156 |
| 4,876,869 | A | * | 10/1989 | Saeki et al. | 72/68 |
| 4,962,658 | A | * | 10/1990 | Komp | 72/283 |
| 5,537,729 | A | * | 7/1996 | Kolobow | 29/527.2 |
| 5,573,567 | A | * | 11/1996 | Shigezane | 65/108 |
| 5,709,021 | A | * | 1/1998 | DiCello et al. | 29/423 |
| 5,881,592 | A | * | 3/1999 | Blackwell et al. | 72/283 |
| 6,134,937 | A | * | 10/2000 | Lee et al. | 72/276 |
| 7,788,959 | B2 | * | 9/2010 | Hayashi | 72/283 |

(Continued)

FOREIGN PATENT DOCUMENTS

CA 2 640 691 8/2009

(Continued)

*Primary Examiner* — Edward Tolan
*Assistant Examiner* — Lawrence J Averick
(74) *Attorney, Agent, or Firm* — Clark & Brody

(57) ABSTRACT

A method of producing an ultrathin-wall metal tube by a cold drawing method includes a diameter-expanding drawing method, in which an entry solid die, the diameter of which increases, remains constant or decreases from the engaging entry side toward the finishing exit side, and a delivery solid die, the diameter of which decreases at least in the vicinity of the engaging entry, are arranged in series and in an abutting relation on the same pass line. A tapered plug, the diameter of which increases from the engaging entry side toward the finishing exit side, floats along the pass line, whereby in the entry solid die region, the wall thickness is reduced while the mid-wall diameter of a hollow shell is being expanded between the solid die and the plug, and in the delivery solid die region, the tapered plug floats by performing reduction working of the outside diameter.

4 Claims, 5 Drawing Sheets

U.S. PATENT DOCUMENTS

| | | | | |
|---|---|---|---|---|
| 2003/0110825 | A1* | 6/2003 | Webb et al. | 72/370.01 |
| 2008/0148795 | A1* | 6/2008 | Hayashi | 72/208 |
| 2009/0193868 | A1* | 8/2009 | Hayashi | 72/283 |
| 2010/0170316 | A1* | 7/2010 | Okui et al. | 72/283 |
| 2010/0193171 | A1* | 8/2010 | Beppu | 165/181 |

FOREIGN PATENT DOCUMENTS

| | | |
|---|---|---|
| JP | 61-219418 | 9/1986 |
| WO | 2009/096034 | 8/2009 |

* cited by examiner

PRIOR ART

PRIOR ART

PRIOR ART

METHOD OF PRODUCING ULTRATHIN-WALL SEAMLESS METAL TUBE USING FLOATING PLUG

TECHNICAL FIELD

The present invention relates to a cold drawing method of an ultrathin-wall seamless metal tube, and provides a method of efficiently producing an ultrathin-wall seamless metal tube in which a diameter-expanding drawing method using a floating plug is adopted to drastically broaden the available size range to produce thinner metal tubes of longer length.

BACKGROUND ART

Metal tubes are subjected to the cold working process when quality, strength and dimensional accuracy in as-hot-rolled condition are not satisfied. In the cold working process, there are available the cold drawing method using a solid die and a plug or a mandrel and the cold rolling method by a cold Pilger mill, and the present invention relates to the cold drawing method.

In the cold drawing method, an end portion of a hollow shell is pointed by a point squeezing machine, surface scale is removed by pickling, lubrication treatment is then performed, and drawing is performed by passing the hollow shell through a die. The cold drawing method is classified as plug drawing, floating plug drawing, mandrel drawing and sinking, and all of them are performed by diameter-reducing working with the aid of dies.

FIG. 1 is a diagram to explain a conventional diameter-reducing drawing method and shows the case of plug drawing. The plug drawing shown in this figure is the most frequently used drawing method, which involves inserting a plug 3 with a plug supporting bar 4 into a hollow shell 1, chucking the pointed end of the hollow shell 1 by use of a chuck 5, passing the hollow shell 1 through a die 2, and drawing the hollow shell 1 in the direction of arrow shown by symbol X in the figure. This method is excellent also in plug exchange and workability and enables high reduction rate to be applied.

In case of mandrel drawing whose explanatory diagram is omitted, a mandrel is inserted into a hollow shell, and the hollow shell is drawn by being passed through a die in the same way as described in FIG. 1 above. High dimensional accuracy and good inner surface quality can be ensured by this method for small-diameter tubes, because the working of inner surfaces of tubes is performed by use of a mandrel. This method is therefore used in the manufacture of high-grade tubes for nuclear and other applications.

As for drawing machines used in cold drawing, those of the chain type by motor driving are widely adopted. Oil-hydraulic and water-hydraulic ones are also used.

In the cold drawing process of metal tubes, frictional resistance is generated between the outer surface of a tube material and the die surface, and between the inner surface of a tube material and the plug or the mandrel surface, and drawing work is performed against the frictional resistance. Therefore, tension is generated in the tube material in a longitudinal direction thereof. Drawing-induced-slenderizing in diameter begins when tensile stress, given by dividing this tension by the cross-sectional area of drawn tube material, increases, and the tube material is to be torn off when tensile stress reaches the deformation resistance of the tube material.

Because the thinner the wall thickness of tube is, the larger the tensile stress in a longitudinal direction of tube tends to be and the more likely the tube is broken off, there is a limit to the wall thickness reduction rate. Therefore, in drawing work which requires a critical increase in thickness reduction rate, it is necessary to repeat drawing work by increasing passes/times of drawing and lubrication treatment becomes necessary whenever the drawing is repeated, thus ending up in high costs. When the work hardening of a tube material is noticeable, annealing work may also be necessary between repeated drawing steps.

Citation List

Patent Literature

Patent Literature 1: PCT/JP2008/051619

SUMMARY OF INVENTION

Technical Problem

The present invention was made in view of the above-described problem, and the technical problem of the invention is to propose a method of producing an ultrathin-wall metal tube by a cold drawing method capable of drastically expanding an available size range to produce much thinner metal tubes. Although the present invention covers mainly a thin-wall seamless metal tube, the scope of the invention also includes a welded metal tube, because also in a thin-wall welded metal tube, nonuniformity in wall thickness occurs in the weld or heat-affected zone and the correction may sometimes be necessary.

Solution to Problem

In order to solve the above-described problem, the present inventors pushed forward with research and development in consideration of conventional problems, obtained the following knowledge, invented a method of producing an ultrathin-wall metal tube by a cold drawing method, and have already proposed the invention as described in Patent Document 1.

In general, the wall thickness working in the plastic deformation of a tube material is achieved by elongating working of the tube material in a longitudinal direction of tube. That is, in the cold drawing of a tube material, drawing is performed during diameter reduction when wall thickness working is performed between a die and a plug or a mandrel, and the tube material is elongated in a longitudinal direction.

In contrast, the present inventors noted that because elongating is intended only in a longitudinal direction in reducing wall thickness of tube material by plastic deformation thereof, reduction of wall thickness is limited, with the result that a further thickness reduction becomes difficult, and the present inventors considered that the above-described problem can be avoided if in the reduction of the wall thickness of tube material by a cold drawing method, the tube material should be elongated in a circumferential direction of tube, as well as, in a longitudinal direction simultaneously.

Incidentally, a study of the rolling of an annular product on a ring mill as an extreme case reveals that the reduction of wall thickness becomes infinitely possible because an annular starting material is elongated only in a circumferential direction and is not elongated in a longitudinal direction (central axis direction).

In the drawing process, a tube material can be elongated also in a longitudinal direction while being elongated in a circumferential direction by performing drawing coupled with diameter-expanding work by use of a plug or a mandrel. The diameter of a hollow shell can be positively expanded by using a plug or mandrel having an inner surface effecting diameter larger than at least the outside diameter of the hollow shell.

If drawing is performed while diameter-expanding work of a hollow shell as described above being applied, a circumferential length in a circumferential direction increases even when the wall thickness decreases, so that the cross section area of the tube material does not decrease so much, thereby providing the advantage that the tensile stress during drawing can be moderated.

The invention disclosed in Patent Literature 1 (hereinafter also referred to as "the prior invention") was completed on the basis of the above-described findings, and the gist thereof is a method of producing an ultrathin-wall metal tube by a cold drawing method described in (a) to (d) below.

(a) A method of producing an ultrathin-wall metal tube by a cold drawing method by use of a drawing machine, which is characterized by inserting a hollow shell with an expanded end, into a solid die, the die increasing or decreasing in diameter gradually from engaging entry side toward finishing exit side, inserting a plug or tapered mandrel into the hollow shell, the plug or tapered mandrel increasing in diameter gradually from engaging entry side toward finishing exit side in a relevant relation to the caliber of the die, gripping the expanded portion by use of a chuck, and drawing the hollow shell in the direction in which the hollow shell moves from engaging entry side toward finishing exit side, whereby elongating is performed between the solid die and the plug or the tapered mandrel by reducing wall thickness while expanding the diameter in the middle of wall thickness, i.e. mid-wall diameter which is an average value of outside diameter and inside diameter of tube material.

(b) The method of producing an ultrathin-wall metal tube by a cold drawing method described in (a) above, which is characterized in that elongating is performed by reducing wall thickness while simultaneously expanding the inside and outside diameters, wherein a diameter-expansion allowance for the inside diameter is kept larger than that for the outside diameter.

(c) The method of producing an ultrathin-wall metal tube by a cold drawing method described in (a) above, which is characterized in that elongating is performed by reducing wall thickness while expanding only the inside diameter, with the outside diameter being kept constant.

(d) The method of producing an ultrathin-wall metal tube by a cold drawing method described in (a) above, which is characterized in that elongating is performed by reducing wall thickness while expanding the inside diameter, with the outside diameter being reduced, wherein a diameter-expansion allowance of the inside diameter is kept larger than a diameter-reduction allowance of the outside diameter.

FIGS. 2(*a*) to 2(*c*) are diagrams showing the diameter-expanding drawing method adopted in the plug drawing in the above-described prior invention. FIG. 2(*a*) shows the case where drawing is performed while expanding the inside and outside diameters simultaneously. FIG. 2(*b*) shows the case where drawing is performed while expanding only the inside diameter, with the outside diameter being kept constant. FIG. 2(*c*) shows the case where drawing is performed while reducing the outside diameter and expanding the inside diameter.

As shown in FIGS. 2(*a*) to 2(*c*), an expanded hollow shell 1 is inserted into a solid die 21 from the finishing exit side thereof, the die increasing in diameter from the engaging entry side (the left side of the solid die 21 in the figure) toward the finishing exit side (the right side of the solid die 21 in the figure).

Furthermore, a plug 31 is inserted into the hollow shell 1, the plug increasing in diameter from the entry side toward the exit side in a relevant relationship with the solid die 21 and having the maximum finishing diameter which is larger than the outside diameter of the hollow shell 1: an end of the expanded hollow shell 1 is gripped by use of a chuck 5: and the hollow shell 1 is drawn in the direction of an arrow indicated by the symbol X in the figure. In this operation, the hollow shell 1 is drawn while the mid-wall diameter thereof, i.e. the diameter in the middle of wall thickness, is being expanded between the plug 31 and the solid die 21. Incidentally, the description of mandrel drawing was omitted.

As described above, prospects for the manufacture of an ultrathin-wall seamless metal tube were obtained from the prior invention. However, in the prior invention, it is necessary to use a drawing machine of such a construction that a tapered plug such as a plug 31 is supported with a plug supporting bar 4. Therefore, the length of the hollow shell 1 is limited, the drawing of longer length tubes is difficult, and yield losses of expanded and pointed portions of tubes cannot be ignored. In order to break through this problem, the present inventors took on challenges in the development of a diameter-expanding drawing method using a floating plug.

The present invention relates to a diameter-expanding cold drawing method using a floating plug. A cold drawing method using a floating plug (however, diameter-reducing work) developed and put into practical use around 1964 was the most epoch-making technology innovation in the 170 year-old history of cold drawing of seamless metal tubes. And this cold drawing enabled the drawing of longer length tubes to be performed and also permitted coil forming by a bull block drawing method.

In a cold drawing method using a floating plug, cold drawing is performed by using a solid die and a tapered plug, the die decreasing in diameter gradually from the engaging entry side toward the finishing exit side, the plug decreasing in diameter gradually from the entry side toward the exit side, similarly. In this case, the reason why the floating of the plug is possible is that the plug is supported by itself due to the balance of forces acting on the plug on the exit side of the diameter-reducing die (a pulling-in force and a retracting force) and comes to a floating condition. In contrast, if a diameter-expanding die and a diameter-expanding plug are used in diameter-expanding drawing, the floating of the plug becomes utterly impossible.

In order to solve this problem, the present inventors found out that it is possible to perform diameter-expanding drawing by arranging two solid dies which are brought into tight contact with each other in an abutting relation on the pass line and causing a diameter-expanding plug to float on the inside of the tube material, whereby diameter-expanding drawing is performed.

That is, in a cold drawing method of an ultrathin-wall metal tube using a floating plug, a first entry solid die which increases, remains constant or decreases in diameter from the engaging entry side toward the finishing exit side, and a second delivery solid die which decreases in diameter at least in the vicinity of the engaging entry, are arranged in series and an abutting relation on the same pass line, and a tapered plug which increases gradually in diameter from the engaging entry side toward the finishing exit side is caused to float along the pass line, whereby in the first entry solid die region, the wall thickness is reduced while expanding the mid-wall diameter, which is an average value of outside diameter and inside diameter of the hollow shell, between the solid die and the plug, and in the vicinity of the entry of the delivery solid die, the tapered plug is caused to float. This enables diameter-expanding drawing to be performed. In this case, wall thickness working may be performed to some extent by use of the second delivery solid die.

The present invention was completed on the basis of the above-described finding and the gist thereof resides in a method of producing an ultrathin-wall seamless metal tube by the diameter-expanding drawing described in (1) to (4) below.

(1) A method of producing an ultrathin-wall seamless metal tube by diameter-expanding drawing that is a cold drawing method of an ultrathin-wall seamless metal tube using a floating plug, which is characterized by: arranging an entry solid die and an delivery solid die in series and in an abutting relation on the same pass line, the entry solid die increasing, remaining constant or decreasing in diameter from the engaging entry side toward the finishing exit side, the delivery solid die decreasing in diameter at least in the vicinity of the engaging entry side; inserting a hollow shell into the entry solid die and the delivery solid die, causing a tapered plug to float along the pass line, the plug increasing in diameter gradually from the engaging entry side toward the finishing exit side, gripping an end of the hollow shell by use of a chuck, and drawing the hollow shell in the direction in which the hollow shell moves from the entry side toward the exit side, whereby in the entry solid die region, the wall thickness is reduced while expanding the mid-wall diameter, which is an average value of outside diameter and inside diameter of the hollow shell, between the solid die and the plug, and in the delivery solid die region, the tapered plug is caused to float by the outside diameter reduction working.

(2) The method of producing an ultrathin-wall seamless metal tube by diameter-expanding drawing described in (1) above, which is characterized in that elongating is performed by reducing the wall thickness while simultaneously expanding the inside diameter and the outside diameter in the entry solid die region, with a diameter-expanding allowance of the inside diameter kept larger than a diameter-expanding allowance of the outside diameter.

(3) The method of producing an ultrathin-wall seamless metal tube by diameter-expanding drawing described in (1) above, which is characterized in that elongating is performed by reducing the wall thickness while expanding only the inside diameter in the entry solid die region, with the outside diameter being kept constant.

(4) The method of producing an ultrathin-wall seamless metal tube by diameter-expanding drawing described in (1) above, which is characterized in that elongating is performed by reducing the wall thickness while reducing the outside diameter and expanding the inside diameter in the entry solid die region.

In the present invention, "ultrathin-wall seamless metal tube" means seamless metal tubes having the ratio t/d of not more than 4.0%, t/d being the ratio of wall thickness t to outside diameter d. Herein, seamless metal tubes include welded metal tubes.

ADVANTAGEOUS EFFECTS OF INVENTION

According to the method of the present invention, an entry solid die which increases, remains constant or decreases in diameter from the engaging entry side toward the finishing exit side, and a delivery solid die which decreases in diameter at least in the vicinity of the engaging entry, are arranged in series and in an abutting relation on the same pass line, a tapered plug which increases gradually in diameter from the engaging entry side toward the finishing exit side, is caused to float along the pass line, whereby in the entry solid die region, the wall thickness is reduced while the mid-wall diameter, which is an average value of outside diameters and inside diameters of the hollow shell, is being expanded between the solid die and the plug, and in the delivery solid die region, the tapered plug is caused to float by performing reduction working of the outside diameter. Therefore, it is possible to drastically broaden an available size range toward much thinner side for seamless metal tubes by a cold drawing method. Also, because the manufacture of longer length tubes becomes possible, it becomes possible to realize the rationalization of processes in all respects such as yield and efficiency.

BRIEF DESCRIPTION OF DRAWINGS

FIG. 2(*a*) shows the case where drawing is performed while simultaneously expanding the inside diameter and the outside diameter. FIG. 2(*b*) shows the case where drawing is performed while expanding only the inside diameter, with the outside diameter being kept constant. FIG. 2(*c*) shows the case where drawing is performed while reducing the outside diameter and expanding the inside diameter.

FIG. 4(*a*) shows the case where drawing is performed while simultaneously expanding the inside diameter and the outside diameter in the entry solid die region. FIG. 4(*b*) shows the case where drawing is performed while expanding only the inside diameter in the entry solid die region, with the outside diameter being kept constant. FIG. 4(*c*) shows the case where drawing is performed while reducing the outside diameter and expanding the inside diameter in the entry sold die region.

DESCRIPTION OF EMBODIMENTS

As described above, the present invention provides a method of producing an ultrathin-wall seamless metal tube by diameter-expanding drawing that is a cold drawing method of an ultrathin-wall seamless metal tube using a floating plug, which is characterized by: arranging an entry solid die and a delivery solid die in series and in an abutting relation on the same pass line, the entry solid die increasing, remaining constant or decreasing in diameter from the engaging entry side toward the finishing exit side, the delivery solid die decreasing in diameter at least in the vicinity of the engaging entry; and inserting a hollow shell into the entry solid die and the delivery solid die, causing a tapered plug, the diameter of which increases gradually from the engaging entry side toward the finishing exit side, to float along the pass line, gripping an end of the hollow shell by use of a chuck, and drawing the hollow shell in the direction in which the hollow shell moves from the entry side toward the exit side, whereby mainly in the entry solid die region, the wall thickness is reduced while the mid-wall diameter of a hollow shell, which is an average value of outside diameter and inside diameter of the hollow shell, is being expanded between the solid die and the plug, and in the delivery solid die region, the tapered plug is caused to float by performing reduction working of the outside diameter. In the following, the method of producing an ultrathin-wall seamless metal tube of the present invention will be further described with reference to drawings.

Figure 3:
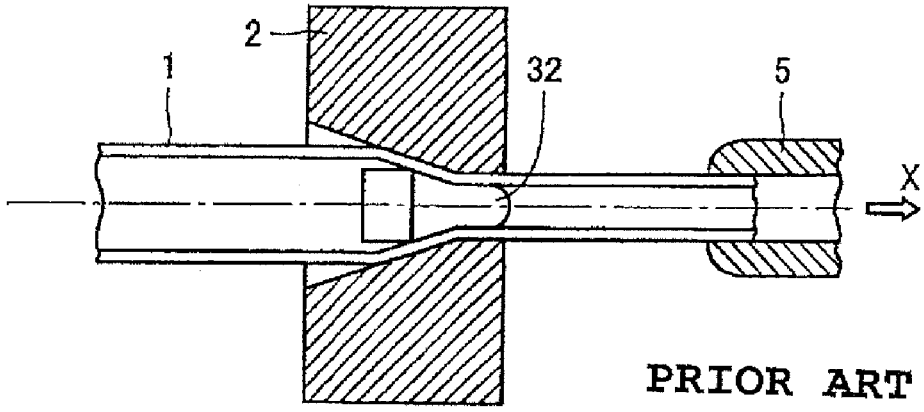
FIG. 3 is an explanatory diagram of a conventional diameter-reducing drawing method using a floating plug.

For comparison, a diagram to explain a conventional diameter-reducing drawing method using a floating plug is shown in FIG. 3. The drawing method is such that a tapered plug 32, the diameter of which decreases gradually from the engaging entry side toward the exit side, is inserted into a hollow shell 1, the hollow shell 1 is passed through a die 2, the diameter of which decreases gradually from the engaging entry side toward the exit side, by gripping an end of the hollow tube 1 by use of a chuck 5, while this tapered plug 32 is caused to float along the pass line, and the hollow shell 1 is drawn in the direction indicated by symbol X in the figure.

However, as described above, if diameter-expanding drawing is intended to be performed by this method by using a diameter-expanding die and a diameter-expanding plug, it is impossible to cause the plug to float.

Figure 4A:
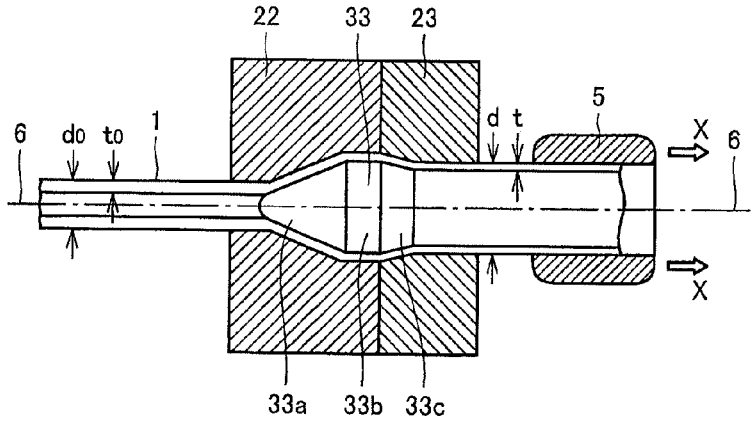
FIGS. 4(*a*) to 4(*c*) are explanatory diagrams of a diameter-expanding drawing method using a floating plug according to the present invention.
Figure 4B:
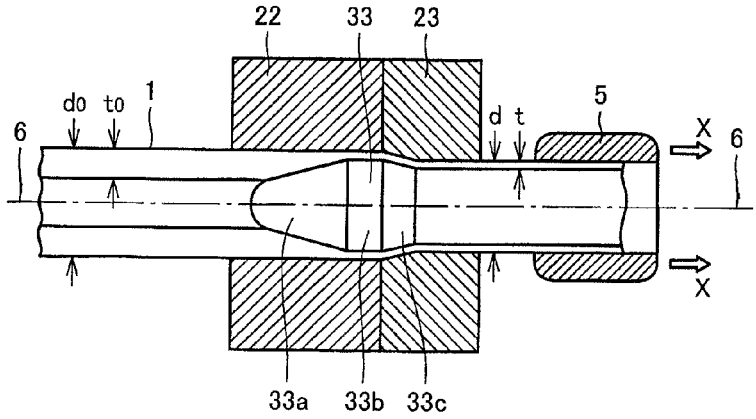
Figure 4C:
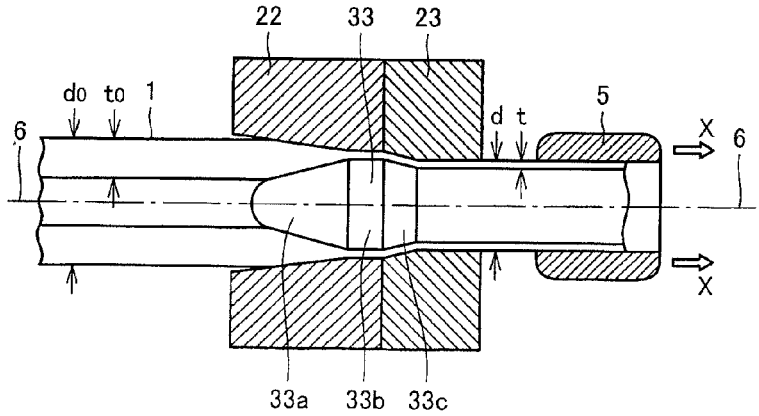

FIGS. 4(*a*) to 4(*c*) are diagrams to explain the modes of a diameter-expanding drawing method using a floating plug according to the present invention. FIG. 4(*a*) shows the mode in which drawing is performed while simultaneously expanding the inside diameter and the outside diameter in the entry solid die region. FIG. 4(*b*) shows the mode in which drawing is performed while expanding only the inside diameter in the entry solid die region, with the outside diameter being kept constant. FIG. 4(*c*) shows the mode in which drawing is performed while reducing the outside diameter and expanding the inside diameter in the entry solid die region.

In the mode shown in FIG. 4(*a*), an entry solid die 22, the diameter of which increases gradually from the engaging entry side toward the finishing exit side, and a delivery solid die 23, the diameter of which decreases in the vicinity of the engaging entry, are arranged in series and in an abutting relation on the same pass line 6. A hollow shell 1 having an outside diameter do and a wall thickness to is inserted into the entry solid die 22 and the delivery solid die 23, a tapered plug 33, the diameter of which increases gradually from the engaging entry side toward the finishing exit side, is caused to float along the pass line 6, an end of the hollow shell 1 is gripped by use of a chuck 5, and the hollow shell 1 is drawn in the direction indicated by symbol X in the figure.

The floating plug according to the present invention comprises a tapered portion 33*a*, a bearing portion 33*b* and a floating portion 33*c*. The wall thickness is reduced while the mid-wall diameter of the hollow shell 1, which is an average value of the outside diameter and inside diameter of the hollow shell 1, is being expanded between the solid die 22 and the tapered portion 33*a* and bearing portion 33*b* of the plug in the entry solid die 22 region. In the delivery solid die 23 region, the tapered plug 33 is caused to float by the action of the floating portion 33*c* of the plug by performing reduction working of the outside diameter, whereby it is possible to manufacture an ultrathin-wall seamless metal tube having an outside diameter d and a wall thickness t by diameter-expanding drawing.

In the mode shown in FIG. 4(*b*), in the entry solid die 22 region, elongating is performed by reducing the wall thickness while expanding only the inside diameter of the hollow shell 1, with the outside diameter being kept constant. In the mode shown in FIG. 4(*c*), in the entry solid die 22 region, elongating is performed by reducing the wall thickness while reducing the outside diameter and expanding the inside diameter.

In all of the modes, in the entry solid die 22 region, drawing is performed while the mid-wall diameter of a hollow shell is being expanded by use of the tapered portion 33*a* and bearing portion 33*b* of the plug. At the same time, in the delivery solid die 23 region, the tapered plug 33 is caused to float by the action of the floating portion 33*c* of the plug by performing reduction working of the outside diameter.

Figure 5A:
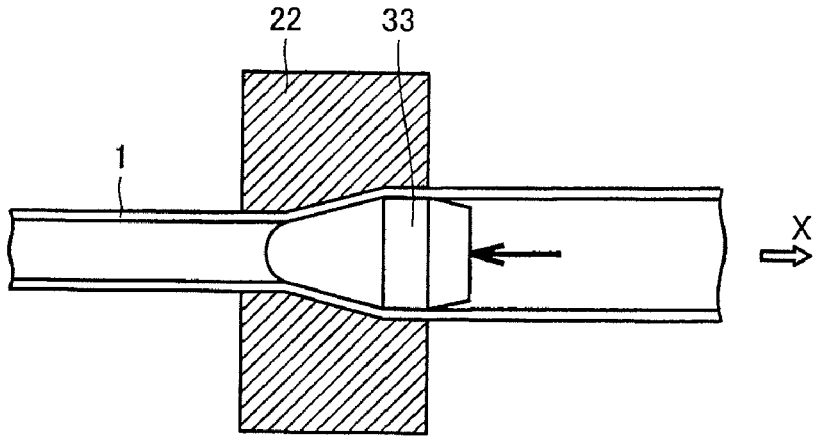
FIGS. 5(*a*) to 5(*c*) are diagrams showing examples of configuration of preparations for carrying out the cold drawing of the present invention.
Figure 5B:
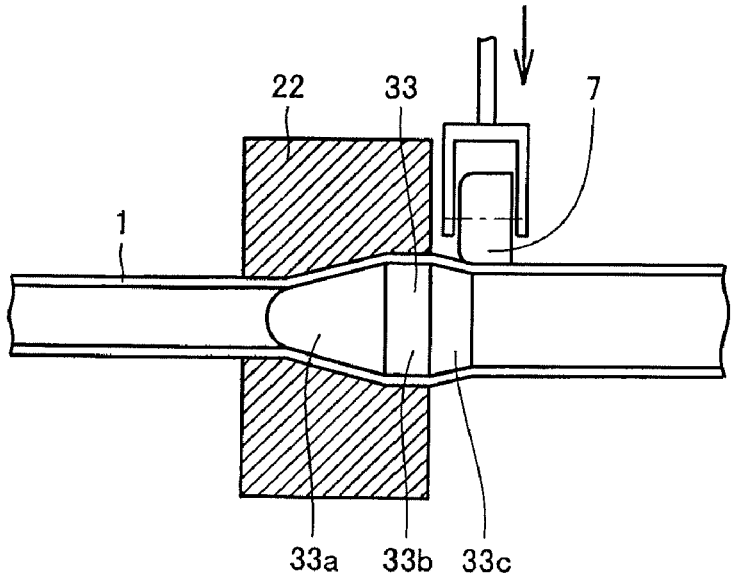
Figure 5C:
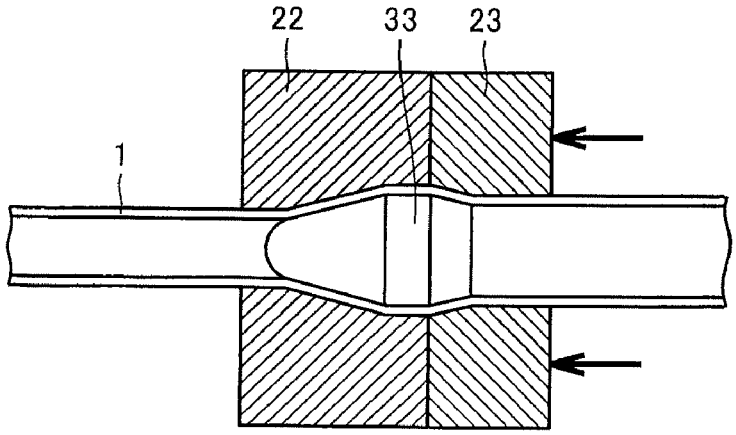

FIGS. 5(*a*) to 5(*c*) are diagrams showing examples of a configuration of preparations for carrying out the cold drawing of the present invention. In carrying out the present invention, there are various kinds of preparations for arranging two solid dies which are brought into tight contact with each other in an abutting relation along the pass line and causing a tapered plug to float on the inside thereof, and these figures show examples of preparations.

Figure 1:
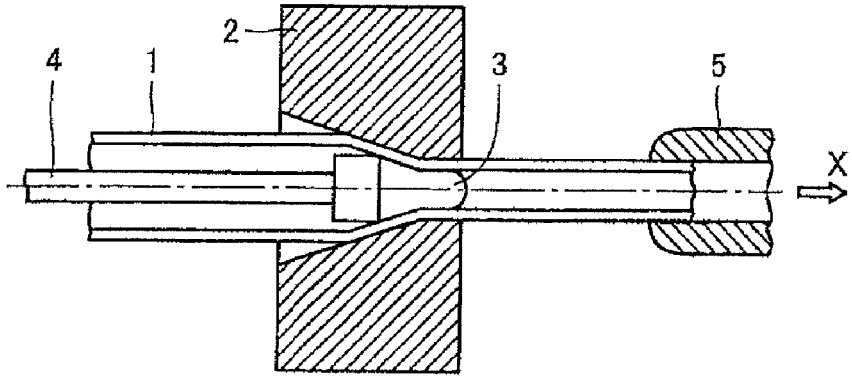
FIG. 1 is an explanatory diagram of a conventional diameter-reducing drawing method by plug drawing.
Figure 2A:
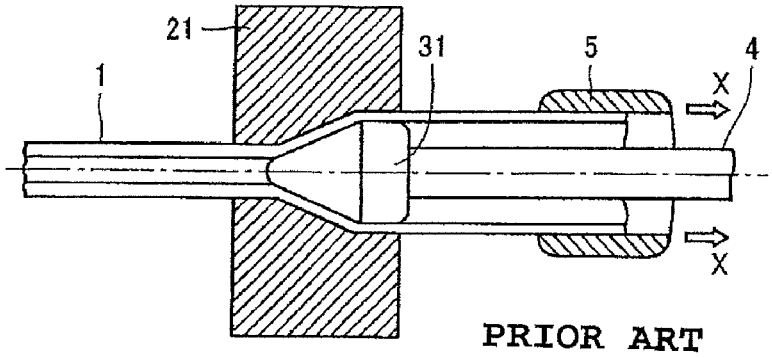
FIGS. 2(*a*) to 2(*c*) are explanatory diagrams of the diameter-expanding drawing method by plug drawing.
Figure 2B:
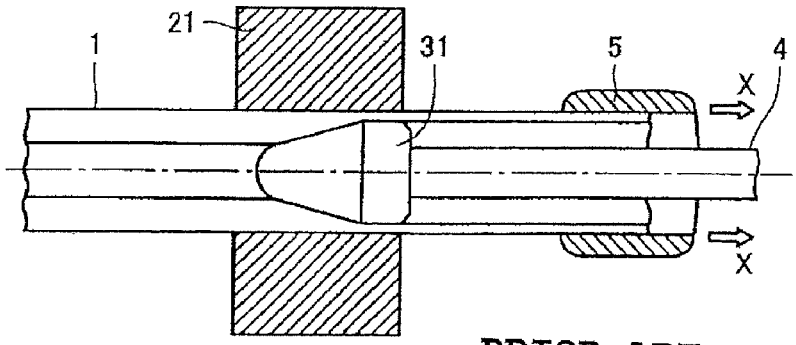
PRIOR ART FIG. 2B
Figure 2C:
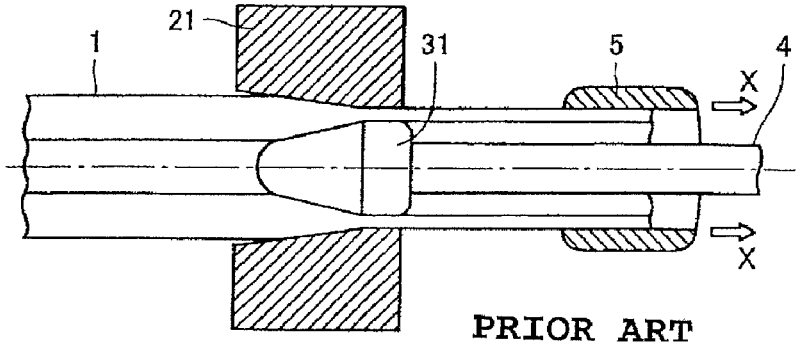
PRIOR ART FIG. 2C

In FIG. 5(*a*), the hollow shell 1 is inserted into the entry solid die 22 from the engaging entry side by publicly-known means (for example, the drawing method shown in FIGS. 2(*a*) to 2(*c*)) and the tapered plug 33 is inserted into the hollow shell 1, whereby the hollow shell 1 is drawn while the diameter is being expanded between the entry solid die 22 and the tapered plug 33. At this time, for the purpose of drawing positioning (the positioning of the finishing portion of the entry solid die 22 relative to the bearing portion 33*b* of the tapered plug 33), it is necessary that the exit side end of the tapered plug 33 beheld.

In FIG. 5(*b*), a reduction roller 7 is provided on the exit side of the tapered plug 33, and the outer peripheral portion of the hollow shell 1 is pressed against the reduction roller 7, whereby the diameter is reduced along the floating portion 33*c* of the plug. At this time, the reduced size of the hollow shell becomes smaller than the finishing size of the delivery solid die 23.

In FIG. 5(*c*), the delivery solid die 23 is fitted from the exit side of the diameter-reduced hollow shell 1 and is arranged in an abutting relation to the entry solid die 22, whereby the tapered plug 33 is caused to float on the inside of the two dies. As a result of this, the preparations for carrying out the cold drawing of the present invention are completed.

EXAMPLE

In order to verify the advantageous effects of the method of producing an ultrathin-wall seamless metal tube by a diameter-expanding drawing method using a floating plug according to the present invention, the following tests were conducted and the results of the tests were evaluated. A test was carried out by the method shown in FIG. 4(*a*) above. For the methods shown in FIGS. 4(*b*) and 4(*c*), the operation and effect are almost the same as in the method of FIG. 4(*a*) and hence in this example, the test result by the method of FIG. 4(*a*) will be described.

An 18% Cr-8% Ni stainless steel tube having an outside diameter of 48.6 mm, an inside diameter of 41.6 mm, and a wall thickness of 3.5 mm produced by the Mannesmann-mandrel mill process was used as a test hollow shell. By use of an entry solid die and a floating plug, the wall thickness was reduced while a diameter expanding process was applied to obtain 53.8 mm in outside diameter and 50.8 mm in inside diameter with a wall thickness of 1.5 mm, and the outside diameter was decreased near the engaging entry side of a delivery solid die, whereby the test hollow shell was finished to an outside diameter of 50.8 mm, an inside diameter of 47.8 mm, and a wall thickness of 1.5 mm.

The test conditions and results are summarized below.

Maximum diameter of tapered plug: dp=50.8 mm

Hollow Shell Size

Hollow shell outside diameter: do=48.6 mm

Hollow shell inside diameter: d'o=41.6 mm

Hollow shell wall thickness: to =3.5 mm

Intermediate Size at the Exit of Entry Solid Die

Outside diameter: 53.8 mm

Inside diameter: 50.8 mm

Wall thickness: 1.5 mm

Product Size at the Exit of Delivery Solid Die

Product outside diameter: d=50.8 mm

Product inside diameter: d'=47.8 mm

Product wall thickness: t=1.5 mm

Diameter expansion ratio: d/do=1.05

Elongation ratio: to (do−to)/{t(d−t)}=2.13

(Wall thickness/outside diameter) ratio: t/d=2.95%

The outer and inner surfaces of a product obtained in the above-described test were beautiful and there was no problem in terms of quality. Incidentally, the minimum wall thickness of austenitic stainless steel tubes by a conventional diameter-reducing drawing method is on the order of 2.4 mm for an outside diameter of 50.8 mm, and it is evident that the advantageous effects of the method of producing a seamless metal tube by the diameter-expanding drawing method using a floating plug according to the present invention are remarkable.

Industrial Applicability

According to the diameter-expanding drawing method using a floating plug according to the present invention, it is possible to drastically expand an available size range toward much thinner wall thicknesses of seamless metal tubes by a cold drawing method. And since using the diameter-expanding drawing method, it becomes possible to economically stably produce seamless metal tubes having wall thicknesses of not more than about two thirds of the wall thicknesses obtained by the conventional diameter-reducing drawing method, ultra-thin-wall welded tubes such as TIG-welded tubes and laser-welded tubes can be replaced with seamless tubes produced by the present invention. Also, because the production of longer length tubes becomes possible due to the adoption of a floating tube, it becomes possible to realize the rationalization of processes in all respects such as yield and efficiency.

Reference Signs List

1: Hollow shell,
2: Die,
3: Plug,
4: Plug supporting bar,
5: Chuck,
6: Pass line,
7: Reduction roller,
21: Solid die,
22: Entry solid die,
23: Delivery solid die,
31: Plug,
32: Floating plug,
33: Floating plug

What is claimed is:

1. A method of producing an ultrathin-wall seamless metal tube having 4.0% or less in terms of t/D, the ratio of wall thickness t to diameter D, by diameter-expanding drawing that is a cold drawing method of an ultrathin-wall seamless metal tube using a floating plug, comprising:

arranging an entry solid die and a delivery solid die in series and in an abutting relation on the same pass line, the entry solid die increasing, remaining constant or decreasing in diameter from an engaging entry side toward a finishing exit side, the delivery solid die decreasing in diameter at least in the vicinity of the engaging entry; and inserting a hollow shell into the entry solid die and the delivery solid die, causing a tapered plug, the diameter of which increases gradually from the engaging entry side toward the finishing exit side, to float along the pass line, gripping an end of the hollow shell by use of a chuck, and drawing the hollow shell in the direction in which the hollow shell moves from the entry side toward the exit side, whereby in the entry solid die region, the wall thickness is reduced while a mid-wall diameter of a hollow shell, which is an average value of outside diameter and inside diameter of the hollow shell, is being expanded between the solid die and the plug, and in the delivery solid die region, the tapered plug is caused to float by performing reduction working of the outside diameter.

2. The method of producing an ultrathin-wall seamless metal tube by diameter-expanding drawing according to claim 1, wherein in the entry solid die region, elongating is performed by reducing the wall thickness while simultaneously expanding the inside diameter and the outside diameter, with a diameter-expanding allowance of the inside diameter kept larger than a diameter-expanding allowance of the outside diameter.

3. The method of producing an ultrathin-wall seamless metal tube by diameter-expanding drawing according to claim 1, wherein in the entry solid die region, elongating is performed by reducing the wall thickness while expanding only the inside diameter, with the outside diameter kept constant.

4. The method of producing an ultrathin-wall seamless metal tube by diameter-expanding drawing according to claim 1, wherein in the entry solid die region, elongating is performed by reducing the wall thickness while reducing the outside diameter and expanding the inside diameter.

* * * * *